US005950048A

United States Patent [19]

Okumura et al.

[11] Patent Number: 5,950,048

[45] Date of Patent: Sep. 7, 1999

[54] IMAGE FORMING APPARATUS

[75] Inventors: Koji Okumura; Ryoji Aoki; Masahiko Hayashi; Minoru Kumida; Masami Makino, all of Gifu, Japan

[73] Assignee: Sanyo Electric Co., Ltd, Moriguchi, Japan

[21] Appl. No.: 09/154,996

[22] Filed: Sep. 17, 1998

[30] Foreign Application Priority Data

Sep. 18, 1997 [JP] Japan ..... 9-253079

[51] Int. Cl.[6] ..... G03G 21/18

[52] U.S. Cl. ..... 399/113; 399/167

[58] Field of Search ..... 399/110, 113, 399/116, 119, 167

[56] References Cited

U.S. PATENT DOCUMENTS 4,702,587 10/1987 Miyoshi ..... 399/110

5,752,132 5/1998 Hazama et al. ..... 399/110 X

*Primary Examiner*—S. Lee

*Attorney, Agent, or Firm*—Darby & Darby

[57] ABSTRACT

An image forming apparatus includes a photosensitive unit and a developing unit, at least one of which is arranged rotatable about a parallel support shaft. In a state that the both units are mounted on an apparatus main body, a developing roller gear (driven gear) of the developing unit is in mesh with a drive gear provided on the photosensitive unit. A drive force is transmitted from the drive gear to the developing roller gear. The developing roller gear and the drive gear are arranged such that a drive force acting on a pitch point has an extension line passing through a center of the parallel support shaft.

4 Claims, 7 Drawing Sheets

IMAGE FORMING APPARATUS

BACKGROUND OF THE INVENTION

1. Field of the Invention

This invention relates generally to image forming apparatuses. More particularly, this invention relates to an image forming apparatus which is applicable, for example, to copiers, laser printers and the like, wherein process members, such as a photosensitive member and a developing roller, are accommodated within a cartridge that is to be dismountably mounted on an apparatus main body.

2. Description of the Prior Art

There is a conventional image forming apparatus of this kind illustrated as one example in FIGS. 6 and 7. A process cartridge 1 includes a photosensitive drum 2 and a developing roller 3 which are in rotatable contact with each other with a center distance L kept constant therebetween. In an image forming apparatus of so-called a contact-development type having a developing roller 3 in contact with a photosensitive drum 2, the contact pressure exerting between the photosensitive drum 2 and the developing roller 3 has a great effect upon quality of images. In order to avoid this, the center distance L is fixedly kept to thereby prevent the contact pressure exerting between these process members from varying. The process cartridge 1 with such a structure is dismountably mounted on an apparatus main body 4 as shown in FIG. 7. When the process cartridge 1 is mounted onto the main body 4, a photosensitive member gear 5 provided in association with the photosensitive drum 2 to transmit a drive source of a not-shown drive motor to the photosensitive drum 2 is brought into engagement with a drive gear 6 provided on the apparatus main body 4, thereby delivering rotation to the photosensitive drum 2. Similarly, a developing roller gear 7 provided in association with the developing roller 3 to transmit a drive force to the developing roller 3 is also brought into engagement with the drive gear 8 provided on the apparatus main body 4, transmitting rotation to the developing roller 3.

However, the both process members are forcibly held in a fixed manner to maintain constant a center distance L between the photosensitive drum 2 and the developing roller 3. Accordingly, where variation is encountered in outside dimensions of the process members or in holes for positioning the process members, the center distance L cannot be kept constant, thus incurring a problem of degradation in images.

In order to cope with this, the conventional structure has been designed to absorb variation in center distance L by using an extremely soft material for a developing roller 3 or covering the developing roller 3 by an elastic film. Also, there is a developing apparatus disclosed in Japanese Utility Model Laying-Open No. S61-203756 [G03G 15/08, 15/00] laid open on Dec. 22, 1986. In this prior art, the variation of contact pressure due to variation in drive force is prevented by providing a rotatable developing unit with a support point located close to a common tangential line on a photosensitive member and a developing roller and further providing a drive gear on a straight line passing through centers of the photosensitive member and the developing roller.

In the former structure, however, there involves many limitations to designing a material of the developing roller crucial to determine image quality and its peripheral arrangements. This raises a great obstruction in pursuing improvement of image quality and resolution.

In the latter structure, on the other hand, when a drive force is acted on by the drive gear in a direction away from a rotation axis of the photosensitive member, the developing roller moves away from the photosensitive member. Conversely, when a drive force is acted by the drive gear in a direction toward the rotation axis of the photosensitive member, there is a fear that the photosensitive member be urged to an excessive extent by the developing roller. That is, in the above prior art having the drive gear arranged on the straight line passing through the centers of the photosensitive member and the developing roller, a force is applied in such a direction that the developing roller is moved away from the photosensitive member (or in a direction of depressing photosensitive member by the developing roller). Thus, there has been a difficulty in maintaining constant the contact pressure that exerts between the photosensitive member and the developing roller.

SUMMARY OF THE INVENTION

Therefore, it is a primary object of this invention to provide an image forming apparatus which is capable of preventing, while simple structure, against image degradation by maintaining constant the contact pressure exhausting between a photosensitive member and a developing roller.

This invention is an image forming apparatus, comprising: a first unit including a rotatably supported photosensitive member and a drive gear for supplying therethrough a drive force; a second unit including a developing roller in rotatable contact with a surface of said photosensitive member and a driven gear in mesh with said drive gear to transmit the drive force to said developing roller; and a parallel support shaft provided, in parallel with a rotation axis of said photosensitive member, on an extension line of the drive force acting at a pitch point of between said drive gear and said driven gear, and rotatably supporting at least one of said first unit and said second unit.

The first unit includes the rotatably supported photosensitive member ans the drive gear for transmit therethrough a drive force. Also, the second unit includes the developing roller in rotatable contact with the surface of the photosensitive member and a driven gear in mesh with the drive gear to transmit the drive force to the developing roller. The parallel support shaft is provided, parallel with the rotation axis of the photosensitive member, on an extension line of the drive force acting at the pitch point between the drive and driven gears. The parallel support shaft further rotatably support at least one of the first unit and the second unit.

In one aspect of this invention, said drive gear and said driven gear are arranged such that the drive force at the pitch point is directed in a vertical direction.

In one embodiment of this invention, said parallel support shaft is provided such that a center axis thereof is located on the extension line.

In another aspect of this invention, said drive gear has a pressure angle equal to an angle defined between a plane passing through a center axis of said photosensitive member and a center axis of said driven gear and a plane passing through a center axis of said drive gear and the center axis of said driven gear.

According to this invention, since the parallel support shaft rotatably support at least one of the first unit and the second unit, it is possible to maintain the contact pressure exerting between the photosensitive member and the developing roller by a self-weight of the at least one unit. Also, since the parallel shaft is provided on an extension line of a drive force acting at the pitch point between the drive and driven gears.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
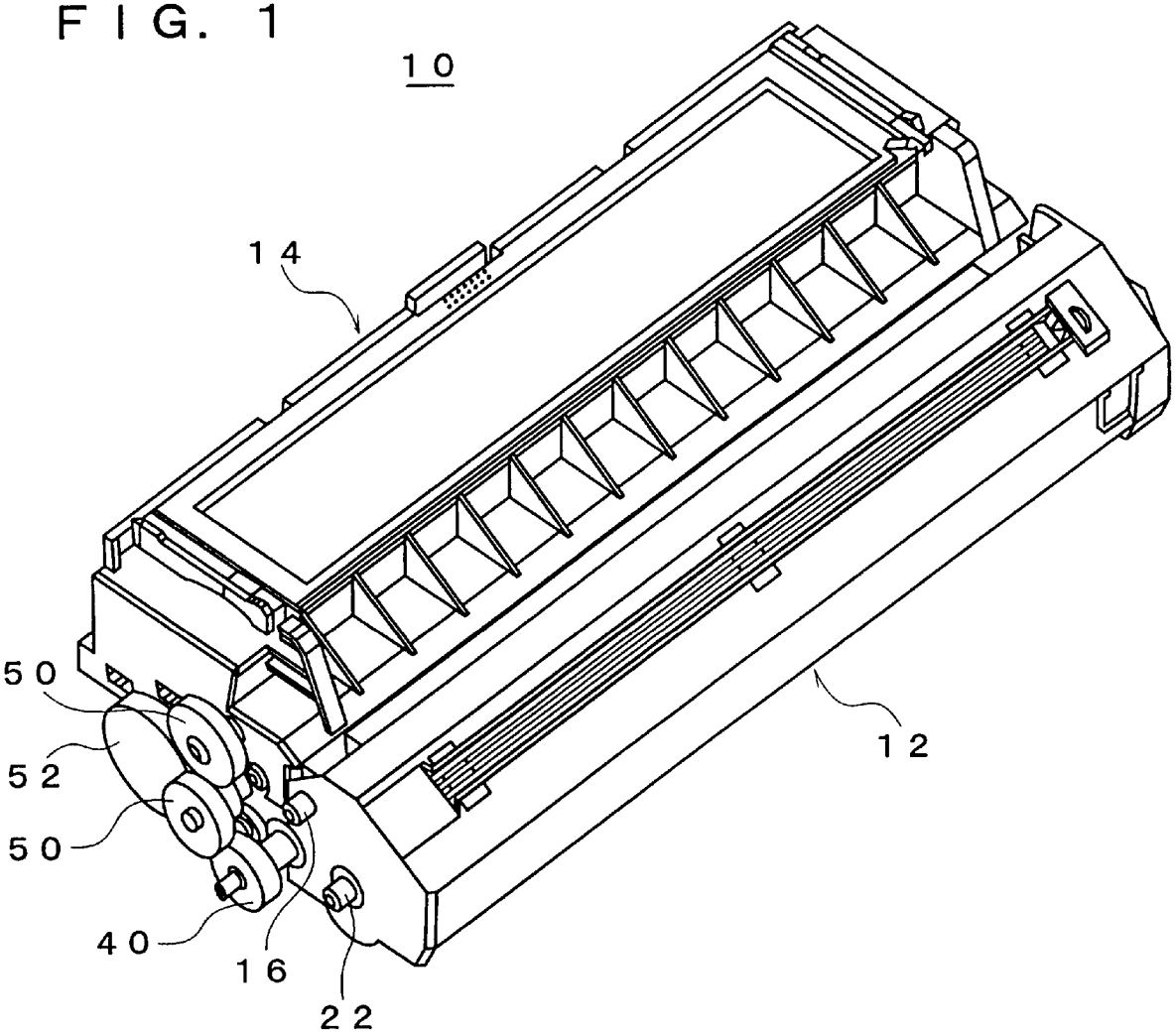
FIG. 1 is a perspective view showing one embodiment of this invention.
Figure 2:
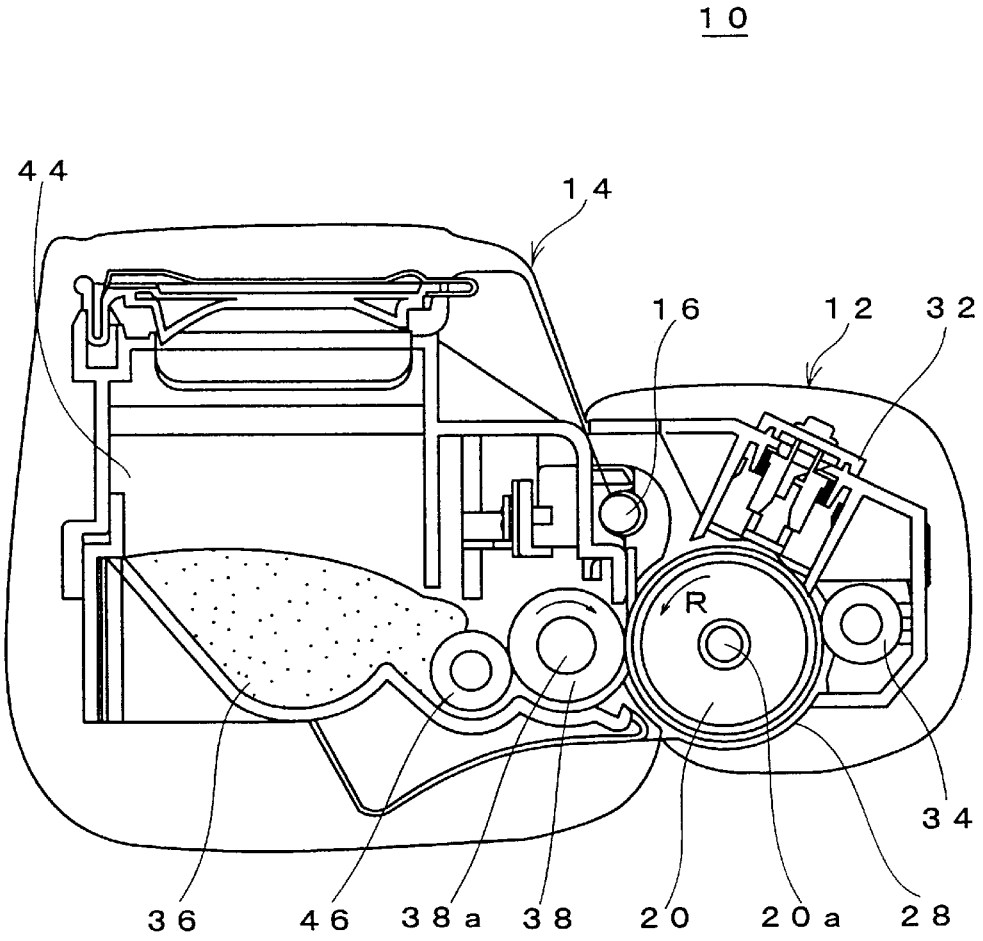
FIG. 2 is a sectional side view of FIG. 1.

Referring to FIGS. 1 and 2, an image forming apparatus 10 includes a photosensitive unit (first unit) 12 and a developing unit (second unit) 14. At least one of the photosensitive unit 12 and the developing unit 14 (or the developing unit 14 in this embodiment) is supported rotatable about a parallel support shaft 16 provided in parallel with a rotation axis of a photosensitive drum 20 hereinafter referred to.

The parallel support shaft 16 is disposed such that its respective ends project from side surfaces of the photosensitive unit 12. Also, projections 22 are generally in a cylindrical form (see FIG. 3) and provided on the respective side surfaces of the photosensitive unit 12, preferably on an axis coaxial to a rotation axis 20*a* of the photosensitive drum 20 (hereinafter referred to). The photosensitive unit 12 is placed in position by bringing the respective ends of the projections 22 and the parallel support shaft 16 into engagement with cut-out portions 26 formed generally in a semicircular form on the apparatus main body 24. That is, the photosensitive unit 12 is positioned by two points, i.e., the parallel support shaft 16 and the projection 22, such that a developing roller gear 40 (hereinafter referred to) and a drive gear 42 (hereinafter referred to) are placed in contact with each other on a vertical plane extending through the rotation axis of the parallel support shaft 16. Then, the developing unit 14 is rotatably engaged with the parallel support shaft 16, thereby mounting the both units 12 and 14 on the apparatus main body 24.

Figure 4:
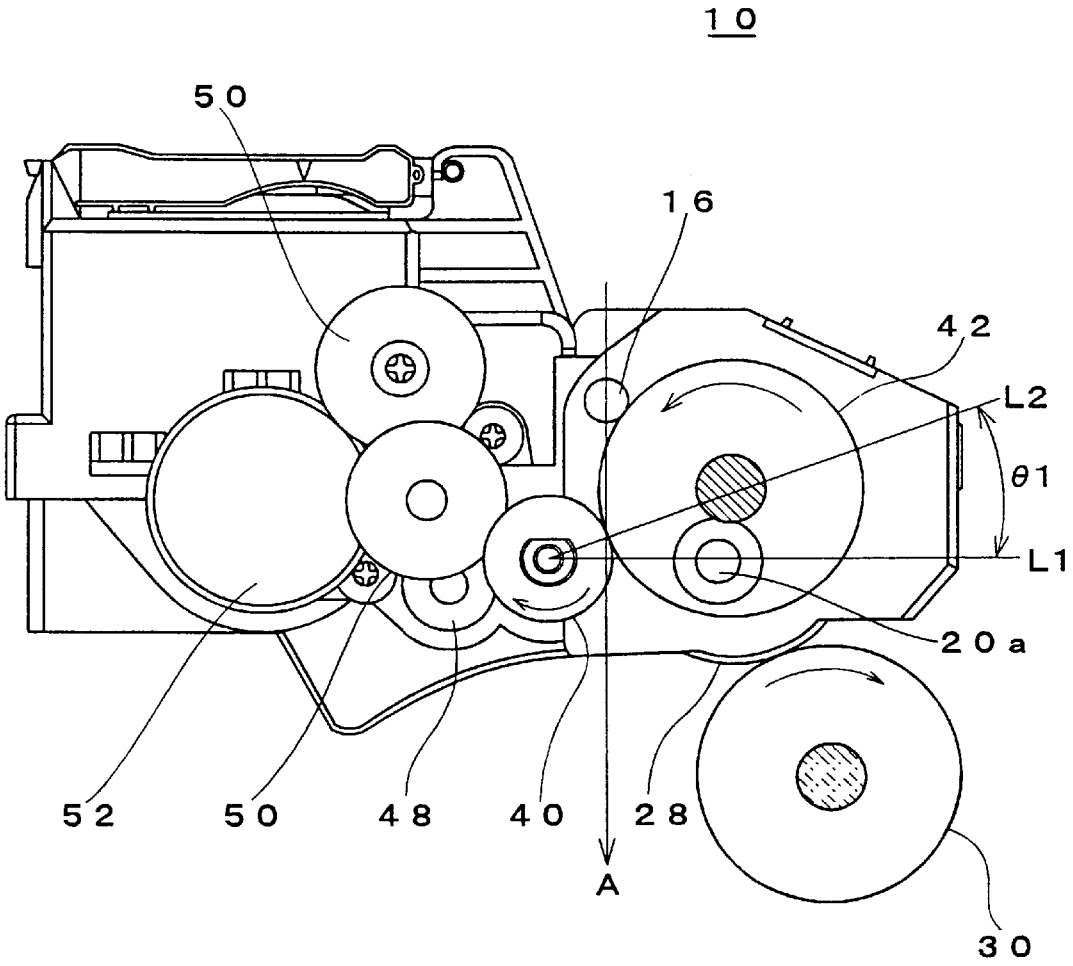
FIG. 4 is a side view of FIG. 1.

The photosensitive unit 12 includes a photosensitive drum 20 serving as an image carrier that is rotatable in a direction of an arrow R. The photosensitive drum 20 is rotatably held within the photosensitive unit 12. The photosensitive drum 20 has its rotation axis 20*a* having at least one end provided with a photosensitive gear 28, as shown in FIG. 4. This photosensitive gear 28 is in mesh with a drive gear 30, and if a drive force is transmitted from a not-shown drive source to the drive gear 30, rotation is delivered to the photosensitive gear 28 (or the photosensitive drum 20). Note that the drive gear 30 is provided on a side of the apparatus main body 24.

An electrifier 32 is provided at a location above the photosensitive drum 20. The electrifier 32 has an electrifying potential controlled by zener diodes (not shown), which evenly charges a surface of the photosensitive drum 20 with electricity. Also, a cleaning roller 34 is provided, on a right side, in contact with the photosensitive drum 20 in order to trap a toner remained on the photosensitive drum 20.

The developing unit 14 includes a developing roller 38 to supply a toner 36 carried on a surface thereof to the photosensitive drum 20. The developing roller 38, in this embodiment, is arranged at such a location that a plane extending through respective centers of a rotation axis 38*a* thereof and a rotation axis 20*a* of the photosensitive drum 20 becomes horizontal in a state that the developing unit 14 is mounted on the apparatus main body 24. When the developing unit 14 is mounted onto the apparatus main body 24, the developing roller 38 is brought into contact, at a predetermined pressure, with a surface of the photosensitive drum 20. That is, since the developing unit 14 is rotatable about the parallel support shaft 16, the developing unit 14 has a force, caused due to its own weight, that acts in a direction toward the photosensitive unit 12. Incidentally, it is needless to say that the contact pressure between the photosensitive drum 20 and the developing roller 38 may be given by using an elastic member such as a spring.

Figure 3:
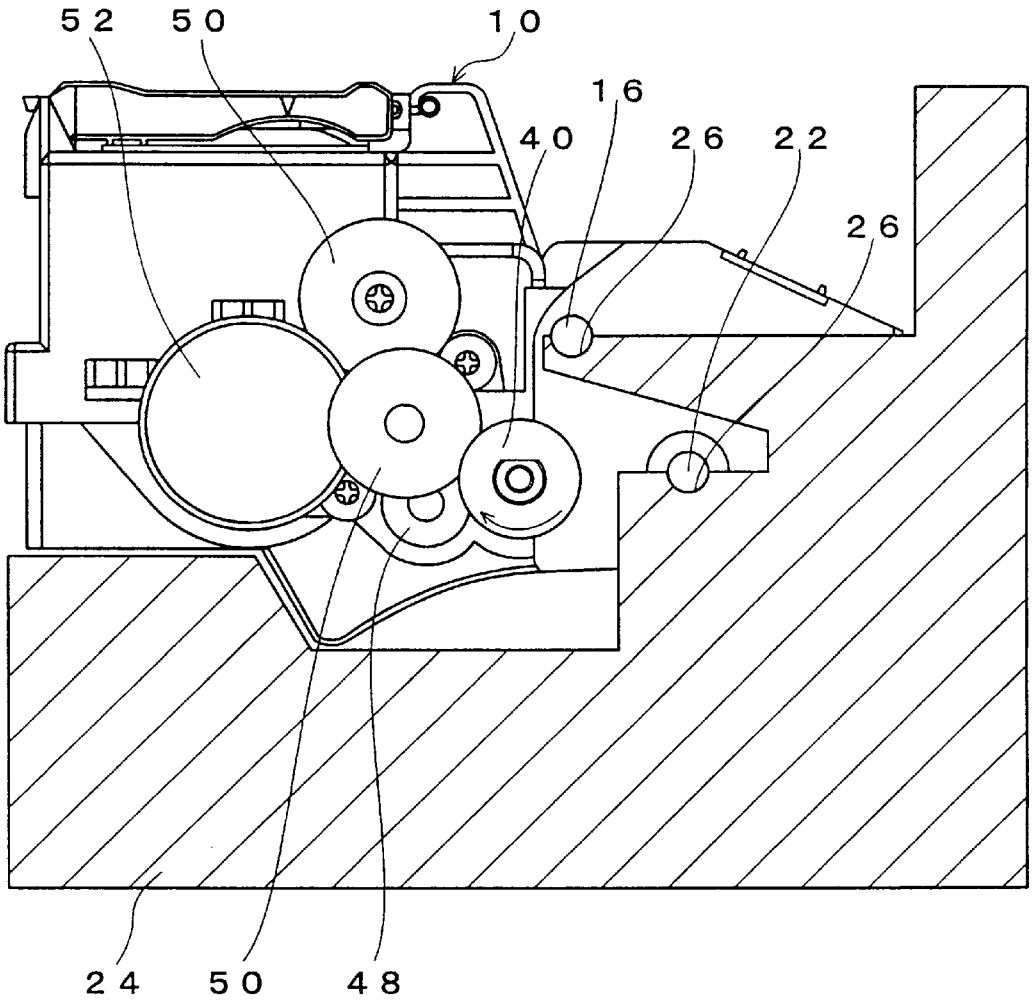
FIG. 3 is a side view showing a state that a photosensitive unit and a developing unit in the FIG. 1 embodiment are mounted on an apparatus main body.

As will be understood from FIGS. 2 and 3, a developing roller gear (or a drive gear) 40 is provided at one end of the rotation axis 38*a* of the developing roller 38. This developing roller gear 40 is in mesh with a drive gear 42 through which rotation is given to the developing roller gear 40 and hence to the developing roller 38. Incidentally, the drive gear 42 is provided on the apparatus main body 24 side, similarly to the above-mentioned drive gear 30. Accordingly, the developing roller gear 40 is brought into mesh with the drive gear 42 when the developing unit 14 is dismountably mounted on the apparatus main body 24.

Further, a supply roller 46 is provided in rotatable contact with the developing roller 38 so as to supply the toner 36 contained within an accommodation chamber 44 to the developing roller 38. The toner 36 is supplied to the supply roller 46 by an agitator (not shown). The agitator is rotatably provided within the accommodation chamber 44 and stirs the toner 36 contained in the accommodation chamber 46. Rotation is delivered to these supply roller 46 and the agitator by a drive force from the drive gear 42. That is, a plurality of gears (not shown) are provided on the rotation axis of the developing roller gear 40 (or the developing roller 38). The respective gears are in mesh with a supply roller gear 48 for transmitting a drive force to the supply roller 46, an idler gear 50, etc. so that a drive force from the drive gear 42 is delivered to the developing roller gear 40, the supply roller gear 48 and the agitator gear 52. Thus, the rotation is delivered to the process members, such as the developing roller 38, that are rotatably arranged within the developing unit 14.

As shown in FIG. 4, at least one of the photosensitive unit 12 and the developing unit 14 is supported rotatable about the parallel support shaft 16, and the photosensitive unit 12 is positioned such that the developing roller gear 40 and the drive gear 42 contact, on a vertical plane extending through a rotation axis of the parallel support shaft 16, with each other, whereby a drive force A is applied, in a vertical direction downward from the axis of the parallel support shaft 16, to a driven gear (or in this embodiment the developing roller gear 40) in mesh with the drive gear 42.

That is, the developing roller gear 40 (or the developing roller 38) and the driven gear 42 are arranged such that an angle θ, defined between a plane L1 passing through the rotation axis of the developing roller gear 40 and the rotation axis 20*a* of the photosensitive drum 20 and a plane L2 passing through the rotation axis of the developing roller gear 40 and the rotation axis of the driven gear 42, becomes equal to a pressure angle of the driven gear 42. This is because, in a contact-developing type image forming apparatus having a photosensitive drum 20 and a developing roller 38 contacted with each other, the rotational speed of the developing roller 38 is generally set at a higher value than the rotational speed of the photosensitive drum 20. Accordingly, a comparatively-strong drive force A is transmitted from the drive gear 42 to a driven gear meshed therewith. This drive force A acts not only on the driven gear (or the developing roller gear 40) but also on the entire developing unit 14 that rotatably supports the developing roller 38. This may result in a problem that the developing unit 14 (or the developing roller 38) be excessively urged toward the photosensitive drum 20 as the direction of the drive force A may be. Conversely, the developing unit 14 may be displaced in a direction away from the photosensitive drum 20, making it difficult to maintain constant the contact pressure between the photosensitive drum 20 and the developing roller 38.

In the present invention, the contact pressure exerting between the photosensitive drum 20 and the developing roller 38 is prevented from being varied by setting the angle θ such that a drive force A is applied, in a vertical direction with respect to the axis of the parallel support shaft 16 (in a common tangential line direction of the photosensitive drum 20 and the developing roller 38), by the drive gear 42 on the apparatus main body 24 to the driven gear (or the developing roller gear 40) in mesh therewith.

Figure 5:
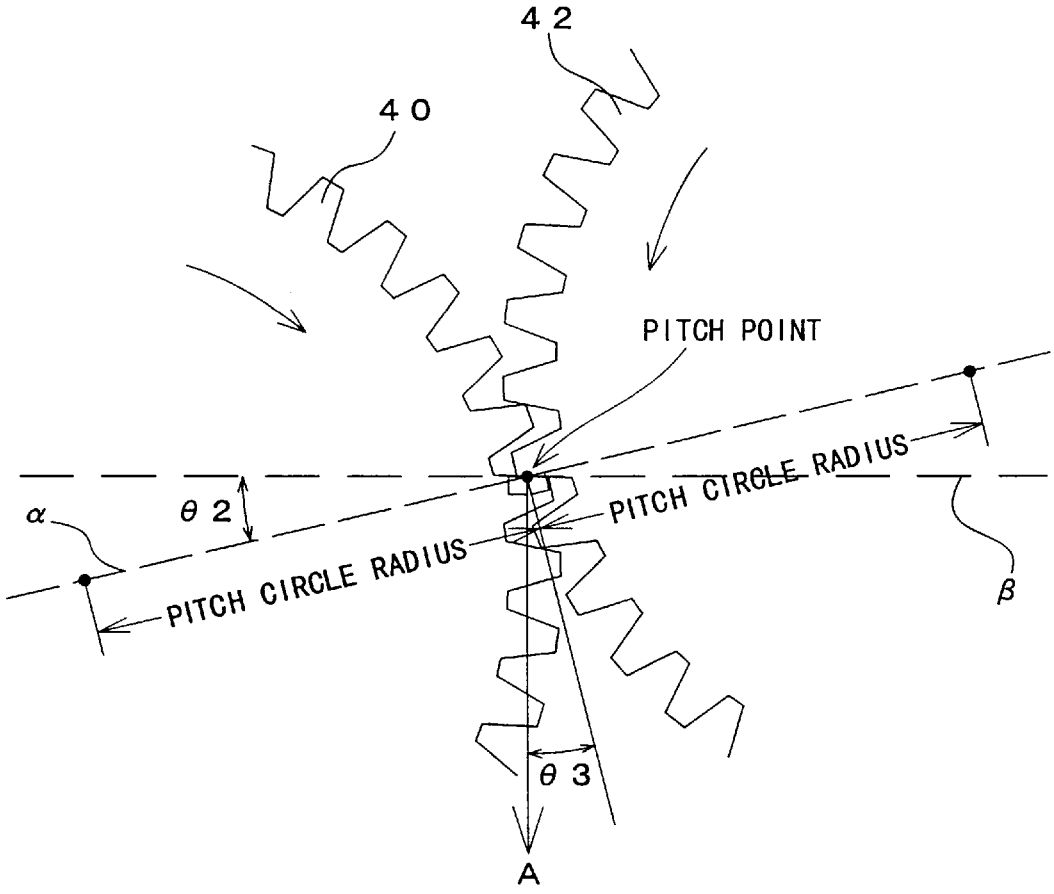
FIG. 5 is an illustrative view showing part of the FIG. 1 embodiment.
Figure 6:
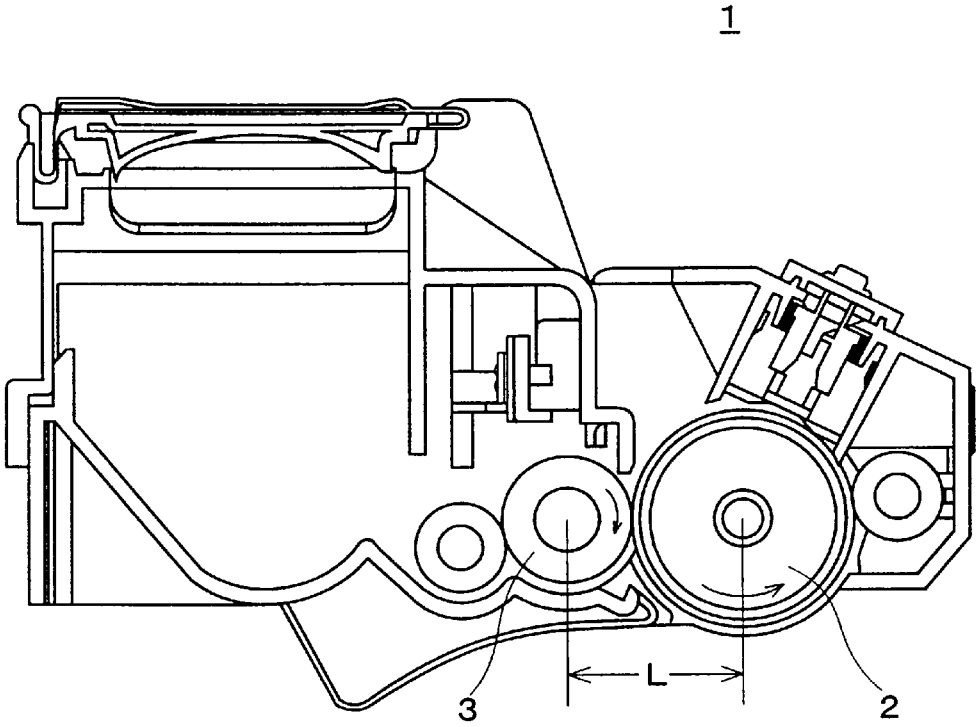
FIG. 6 PRIOR ART
FIG. 6 is a sectional side view showing a process cartridge of a prior art.
Figure 7:
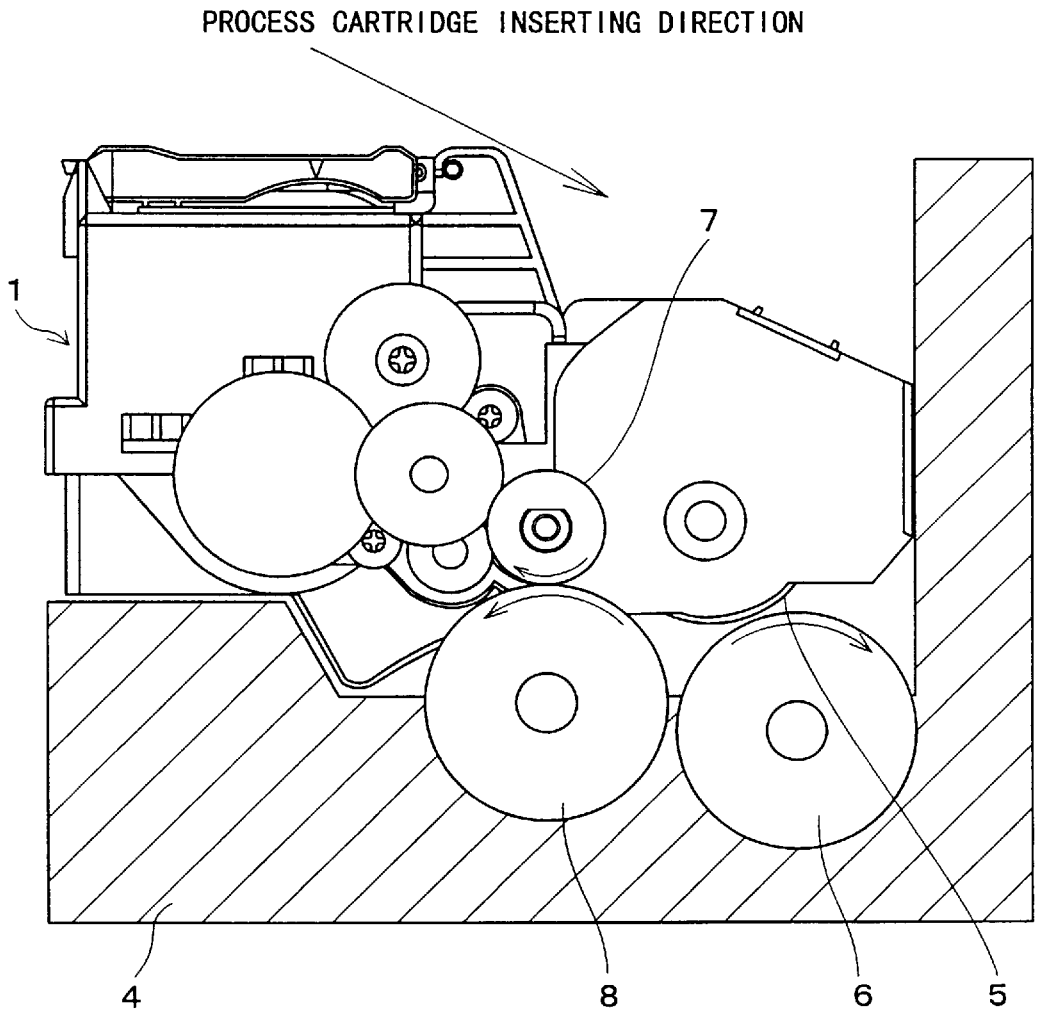
FIG. 7 PRIOR ART
FIG. 7 is a side view showing a state that the process cartridge of FIG. 6 is mounted on the apparatus main body.

Specifically, the drive gear 42 and the developing roller gear 40 are arranged as shown in FIG. 5. The drive gear 42 and the developing roller gear 40 have therebetween a contact point constituting a pitch point. The drive gear 42 has a pitch circle passing through the pitch point and having a center located at a rotation axis of the drive gear 42, while the developing roller gear 40 has its pitch circle passing through the pitch point and having a center at a rotation axis of the developing roller gear 40. A pressure angle is given as an acute angle θ 2 defined between a radial line α, passing through the respective center axes of the drive gear 42 and the developing roller gear 40 as well as through the pitch point, and a tangential line β given at the pitch point on a tooth surface. The drive gear 42 and the developing roller gear 40 are arranged such that this acute angle θ 2 becomes equal to an acute angle θ 1 shown in FIG. 4. The acute angle θ 2 is further equal to an acute angle θ 3 shown in the same figure. As a result, the drive force A acts in a vertical direction, wherein the drive force A has an extension line passing through the center axis of the parallel support shaft 16.

As stated above, the contact pressure between the photosensitive drum 20 and the developing roller 38 is determined by a self-weight of the developing unit 14 or by using an elastic member such as an externally added spring. It is therefore possible to select a material for the developing roller 38 from a wide range of materials without considering on outside dimensional variation in a developing roller 38 and the photosensitive drum 20 as well as variation in center distance (L) given between these process members.

Also, since the drive force A has an extension line passing through a center of the parallel support shaft 16, the drive force A has zero horizontal component. Due to this, the drive force A has virtually no effect upon the contact pressure exerted between the photosensitive member and the developing roller, thus stabilizing the contact pressure. That is, it is possible to prevent image quality from deteriorating due to aging.

Incidentally, in this embodiment the drive force A acting on at the pitch point was in the vertical direction. However, the drive force A is not necessarily in the vertical direction provided that the extension line of the drive force A passes through the center of the parallel support shaft.

Also, in this embodiment the developing roller gear 40 was in mesh with the drive gear 42. Alternatively, the drive gear 42 may be in mesh with the supply roller gear 48 so that the process members such as the developing roller gear 40, etc. can be driven through the supply roller gear 48. In such a case, the effect is available similarly to the above embodiment, by providing a drive force A passing through the center of the parallel support shaft 16 to the supply roller gear 48 (or the driven gear).

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a first unit including a rotatably supported photosensitive member and a drive gear for supplying therethrough a drive force;

a second unit including a developing roller in rotatable contact with a surface of said photosensitive member and a driven gear in mesh with said drive gear to transmit the drive force to said developing roller; and a parallel support shaft provided, in parallel with a rotation axis of said photosensitive member, on an extension line of the drive force acting at a pitch point of between said drive gear and said driven gear, and rotatably supporting at least one of said first unit and said second unit.

2. An image forming apparatus according to claim 1, wherein said drive gear and said driven gear are arranged such that the drive force at the pitch point is directed in a vertical direction.

3. An image forming apparatus according to claim 2, wherein said parallel support shaft is provided such that a center axis thereof is located on the extension line.

4. An image forming apparatus according to claim 1, wherein said drive gear has a pressure angle equal to an angle defined between a plane passing through a center axis of said photosensitive member and a center axis of said driven gear and a plane passing through a center axis of said drive gear and the center axis of said driven gear.

* * * * *